US011136155B2

(12) United States Patent
Koike et al.

(10) Patent No.: US 11,136,155 B2
(45) Date of Patent: Oct. 5, 2021

(54) BAG-MAKING AND PACKAGING MACHINE

(71) Applicant: ISHIDA CO., LTD., Kyoto (JP)

(72) Inventors: Shinji Koike, Ritto (JP); Kento Fujita, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 103 days.

(21) Appl. No.: 16/704,680

(22) Filed: Dec. 5, 2019

(65) Prior Publication Data

US 2020/0207499 A1 Jul. 2, 2020

(30) Foreign Application Priority Data

Dec. 27, 2018 (JP) ..... JP2018-245371

(51) Int. Cl.
*B65B 51/30* (2006.01)
*B65B 9/207* (2012.01)
*B65B 9/213* (2012.01)

(52) U.S. Cl.
CPC ..... *B65B 51/303* (2013.01); *B65B 9/207* (2013.01); *B65B 9/213* (2013.01)

(58) Field of Classification Search
CPC ..... B65B 9/20; B65B 9/2042; B65B 9/207; B65B 9/213; B65B 39/005; B65B 51/26; B65B 51/30; B65B 51/303; B65B 51/306
USPC ..... 53/451, 551, 552
See application file for complete search history.

(56) References Cited

U.S. PATENT DOCUMENTS 3,262,244 A 7/1966 Cutler et al.
4,563,862 A * 1/1986 McElvy ..... B65B 9/213 53/552
4,709,532 A 12/1987 Taylor
5,014,493 A * 5/1991 West ..... B65B 9/213 53/128.1

(Continued)

FOREIGN PATENT DOCUMENTS

DE 102004007826 A1 * 9/2005 ..... B65B 51/303
DE 102004007827 A1 * 9/2005 ..... B65B 51/303

(Continued)

OTHER PUBLICATIONS

Office Action in the corresponding Indian Patent Application No. 201914052583, dated Jan. 19, 2021.

(Continued)

*Primary Examiner* — Stephen F. Gerrity
(74) *Attorney, Agent, or Firm* — Global IP Counselors, LLP

(57) ABSTRACT

A bag-making and packaging machine packages, in bags made from a film, articles discharged and dropped from an article discharge apparatus. The bag-making and packaging machine has a transverse sealing mechanism, a receiving member, a vertical moving mechanism, and a control unit. The transverse sealing mechanism transversely seals a film tube. The receiving member contacts an outer surface of the film tube above the transverse sealing mechanism and receives the articles A that drop through the inside of the film tube. The vertical moving mechanism moves the transverse sealing mechanism and the receiving member in the up and down direction. The control unit switches between a first (Continued)

mode and a second mode. In the second mode, the receiving member contacts the outer surface of the film tube at a lower height position than in the first mode.

10 Claims, 9 Drawing Sheets

(56) References Cited

U.S. PATENT DOCUMENTS

| | | | | | |
|---|---|---|---|---|---|
| 5,170,609 | A * | 12/1992 | Bullock et al. | B65B 9/213 | 53/434 |
| 5,335,479 | A * | 8/1994 | Lemke et al. | B65B 9/213 | 53/426 |
| 5,622,033 | A * | 4/1997 | Fukuda | B65B 51/30 | 53/551 |
| 6,189,301 | B1 * | 2/2001 | Nakagawa et al. | B65B 9/207 | 53/248 |
| 6,367,230 | B1 * | 4/2002 | Fukuda | B65B 9/207 | 53/451 |
| 6,427,422 | B2 * | 8/2002 | Nakagawa et al. | B65B 9/213 | 53/437 |
| 2002/0002810 | A1 | 1/2002 | Nakagawa et al. | | |
| 2018/0016047 | A1 | 1/2018 | Miyamoto et al. | | |

FOREIGN PATENT DOCUMENTS

| | | | | | |
|---|---|---|---|---|---|
| EP | 3078601 | A1 | | 10/2016 | |
| EP | 3385176 | A1 | | 10/2018 | |
| FR | 2240865 | A1 | * | 3/1975 | B65B 9/213 |
| GB | 1278562 | A | * | 6/1972 | B65B 9/213 |
| GB | 1444374 | A | | 7/1976 | |
| JP | S63-152507 | A | | 6/1988 | |
| JP | 2000-095205 | A | | 4/2000 | |
| JP | 4345903 | B2 | | 10/2009 | |
| JP | 2016132454 | A | | 7/2016 | |
| WO | 0021834 | A1 | | 4/2000 | |

OTHER PUBLICATIONS

The extended European search report dated Aug. 5, 2020.
Australian Patent Application 2019283908, the Examination report No. 1 dated Jun. 18, 2020.

* cited by examiner

BAG-MAKING AND PACKAGING MACHINE

CROSS-REFERENCE TO RELATED APPLICATIONS

This application claims priority under 35 U.S.C. § 119(a) to Japanese Patent Application No. 2018-245371, filed in Japan on Dec. 27, 2018, the entire contents of which are hereby incorporated herein by reference.

BACKGROUND

Technical Field

The present invention relates to a bag-making and packaging machine.

Related Art

Patent document JP-A No. S63-152507 discloses a bag-making and packaging machine having a catcher for inhibiting damage to articles that have dropped through the inside of a tubular packaging material and to the packaging material. The catcher contacts an outer surface of the packaging material above a transverse sealing mechanism that transversely seals the packaging material and alleviates shock when the articles drop.

SUMMARY

Technical Problem

However, in a case where the articles to be sealed in one bag are dropped over multiple times, it is preferred that after the first drop of the articles, the transverse sealing mechanism be temporarily separated from the packaging material to protect the packaging material. In this case, the catcher also separates from the packaging material, so it is necessary to bring the catcher back into contact with the outer surface of the packaging material at the time of the next drop of the articles. Because of this, there is the concern that the articles inside the packaging material will become pinched by the catcher, and that the articles inside the packaging material and the packaging material will sustain damage.

To solve this problem, there is the method of using the shutter that the bag-making and packaging machine disclosed in patent document JP-A No. 2000-95205 has. The shutter is installed above the transverse sealing mechanism and temporarily catches the articles that have dropped through the inside of the packaging material. However, if the shutter is attached to an existing bag-making and packaging machine, there is the concern that costs for significantly retrofitting the bag-making and packaging machine will occur.

It is an object of the present invention to provide a bag-making and packaging machine that can inhibit, at a low cost, damage to articles that have dropped through the inside of a tubular packaging material and to the packaging material.

Solution to Problem

A bag-making and packaging machine pertaining to a first aspect of the invention packages, in bags made from a packaging material, articles discharged and dropped from an article discharge apparatus. The bag-making and packaging machine has a transverse sealing mechanism, a receiving member, a moving mechanism, and a control unit. The transverse sealing mechanism transversely seals the packaging material which is tubular in shape and conveyed downward from above. The receiving member is disposed integrally with the transverse sealing mechanism above the transverse sealing mechanism. The receiving member contacts an outer surface of the packaging material and receives the articles that drop through the inside of the packaging material. The moving mechanism moves the transverse sealing mechanism and the receiving member in the up and down direction. The control unit switches between a first mode and a second mode. The first mode is a mode in which the receiving member contacts the outer surface at a first height position. The second mode is a mode in which the receiving member contacts the outer surface at a second height position lower than the first height position.

This bag-making and packaging machine can inhibit damage to the articles and to the packaging material caused by the receiving member pinching the articles in a case where the receiving member receives over multiple times the articles to be packaged in a bag.

A bag-making and packaging machine pertaining to a second aspect of the invention is the bag-making and packaging machine pertaining to the first aspect, wherein the first mode is a mode in which the receiving member contacts the outer surface above a seal portion of the packaging material that has been transversely sealed by the transverse sealing mechanism. The second mode is a mode in which the receiving member contacts the seal portion.

A bag-making and packaging machine pertaining to a third aspect of the invention is the bag-making and packaging machine pertaining to the second aspect, wherein the second mode is a mode in which lower portions of the receiving member contact the seal portion and upper portions of the receiving member contact the outer surface above the seal portion.

A bag-making and packaging machine pertaining to a fourth aspect of the invention is the bag-making and packaging machine pertaining to the second aspect or third aspect, wherein the first mode is a mode in which the transverse sealing mechanism is in a height position at which it can transversely seal the packaging material. The second mode is a mode in which the transverse sealing mechanism is in a lower height position than the seal portion.

A bag-making and packaging machine pertaining to a fifth aspect of the invention is the bag-making and packaging machine pertaining to any one of the first to fourth aspects, wherein the receiving member receives one time or multiple times the articles discharged from the article discharge apparatus in a packaging process in which the articles are packaged in one of the bags.

A bag-making and packaging machine pertaining to a sixth aspect of the invention is the bag-making and packaging machine pertaining to any one of the first to fourth aspects, wherein the receiving member receives multiple times the articles discharged from the article discharge apparatus in a packaging process in which the articles are packaged in one of the bags. The control unit controls the moving mechanism on the basis of the first mode until the receiving member first receives the articles in the packaging process. The control unit switches from the first mode to the second mode in a case where a predetermined amount of time has elapsed since the receiving member first received the articles in the packaging process and the control unit had been controlling the moving mechanism on the basis of the first mode at the latest point in time when the receiving member received the articles.

A bag-making and packaging machine pertaining to a seventh aspect of the invention is the bag-making and packaging machine pertaining to any one of the first to sixth aspects, wherein the control unit sends to the article discharge apparatus a discharge request signal requesting a discharge of the articles from the article discharge apparatus, receives from the article discharge apparatus a discharge completion signal indicating that the article discharge apparatus that received the discharge request signal has completed the discharge of the articles, and switches from the first mode to the second mode in a case where it has not received the discharge completion signal within a predetermined amount of time since the point in time when it sent the discharge request signal.

A bag-making and packaging machine pertaining to an eighth aspect of the invention is the bag-making and packaging machine pertaining to the sixth aspect or the seventh aspect, wherein the predetermined amount of time is at least an amount of time required for the transverse sealing mechanism to transversely seal the packaging material.

A bag-making and packaging machine pertaining to a ninth aspect of the invention is the bag-making and packaging machine pertaining to any one of the first to eighth aspects, wherein the control unit switches from the second mode to the first mode in a case where it is controlling the moving mechanism on the basis of the second mode and it has received from the article discharge apparatus a signal indicating that the articles to be packaged in one of the bags have all been discharged.

Advantageous Effects of Invention

The bag-making and packaging machine pertaining to the invention can inhibit, at a low cost, damage to articles dropped through the inside of a tubular packaging material and to the packaging material.

DETAILED DESCRIPTION

An embodiment of the invention will now be described with reference to the drawings. The embodiment described below is a specific example of the invention and is not intended to limit the technical scope of the invention.

(1) Overall Configuration

Figure 1:
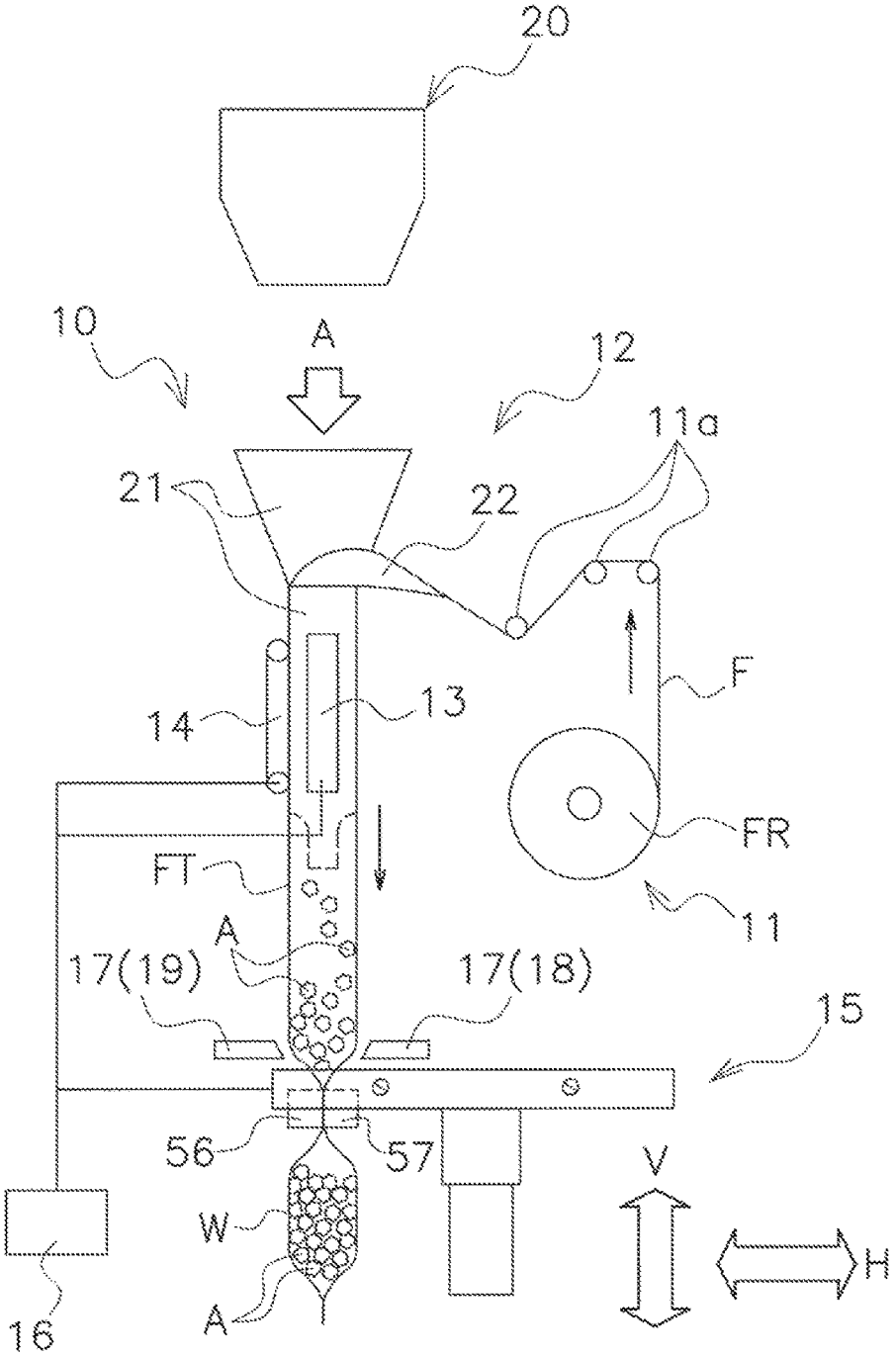
FIG. 1 is a general view showing the overall configuration of a bag-making and packaging machine 10.

FIG. 1 is a general view showing the overall configuration of a bag-making and packaging machine 10 that is an embodiment of the invention. FIG. 1 is a side view of the bag-making and packaging machine 10. Above the bag-making and packaging machine 10 is installed an article discharge apparatus 20. The article discharge apparatus 20 drops, and discharges downward, articles A. The bag-making and packaging machine 10 packages the articles A discharged and dropped from the article discharge apparatus 20. The bag-making and packaging machine 10 makes bags W from a film F and packages the articles A by putting the articles A into and sealing the bags W.

The bag-making and packaging machine 10 mainly has a film roll support unit 11, a former 12, pull-down belts 13, a longitudinal sealing mechanism 14, a transverse sealing mechanism 15, a control unit 16, and a receiving member 17.

(2) Detailed Configuration (2-1) Film Roll Support Unit

The film roll support unit 11 supports a film roll FR. The film F is pulled out from the film roll FR supported by the film roll support unit 11. The film F pulled out from the film roll FR is fed via plural rollers 11*a* to the former 12.

(2-2) Former

The former 12 forms the film F into a tubular shape by curving the film F and overlapping both width direction end portions of the film F on top of each other. The former 12 has a tube 21 and a sailor's collar 22. The film F fed from the film roll support unit 11 is formed into a tubular shape as a result of being curved by the sailor's collar 22 and passing between the tube 21 and the sailor's collar 22. The film F formed into the tubular shape is guided downward along the tube 21. The articles A discharged from the article discharge apparatus 20 drop through the inside of the tube 21 and are fed downward.

(2-3) Pull-down Belts

The pull-down belts 13 convey the tubular film F downward from above along the tube 21. The pull-down belts 13 are driven by a motor (not shown in the drawings).

(2-4) Longitudinal Sealing Mechanism

The longitudinal sealing mechanism 14 longitudinally seals the tubular film F to make a film tube FT. The portions that are longitudinally sealed are the portions overlapped on top of each other by the former 12. The longitudinal sealing mechanism 14 seals the tubular film F in the vertical direction V by pressing the tubular film F against the tube 21 and applying heat to the tubular film F. The longitudinal sealing mechanism 14 has, for example, a heater for sealing the tubular film F. As shown in FIG. 1, the articles A discharged from the article discharge apparatus 20 and dropped through the inside of the tube 21 drop through the inside of the film tube FT below the tube 21.

(2-5) Transverse Sealing Mechanism

The transverse sealing mechanism 15 transversely seals the film tube FT to make the bags W. The transverse sealing mechanism 15 has a first sealing jaw 56 and a second sealing jaw 57. The first sealing jaw 56 and the second sealing jaw 57 are each movable in the horizontal direction H toward or away from each other. The first sealing jaw 56 and the second sealing jaw 57 are also movable in the vertical direction V. The transverse sealing mechanism 15 seals the film tube FT in the horizontal direction H by clamping and applying heat to the film tube FT with the first sealing jaw 56 and the second sealing jaw 57.

(2-6) Control Unit

The control unit 16 is configured to control the pull-down belts 13, the longitudinal sealing mechanism 14, the transverse sealing mechanism 15, and other actuators. The control unit 16 is further configured to receive and process signals from various sensors. The control unit 16 can include, for example, a microcomputer with memory and electronic storage.

(2-7) Receiving Member

The receiving member 17 is installed above the transverse sealing mechanism 15 and below the longitudinal sealing mechanism 14. The receiving member 17 contacts an outer surface of the film tube FT and receives the articles A that drop through the inside of the film tube FT. By receiving the articles A, the receiving member 17 reduces shock when the articles A that have dropped through the inside of the film tube FT hit the film tube FT and inhibits damage to the articles A inside the film tube FT and to the film tube FT.

(3) Configuration of Transverse Sealing Mechanism

Figure 2:
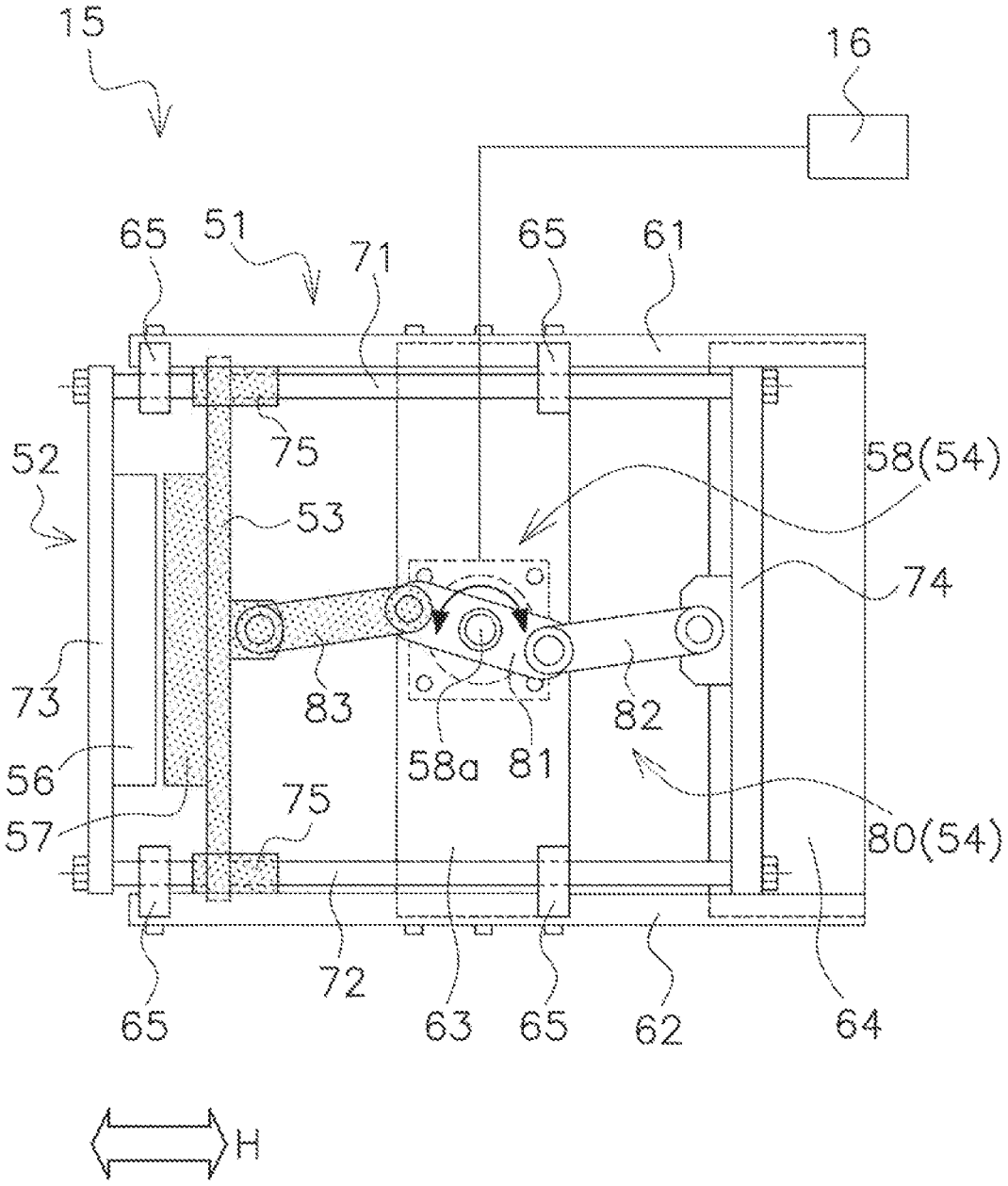
FIG. 2 is a plan view of a transverse sealing mechanism 15.
Figure 3:
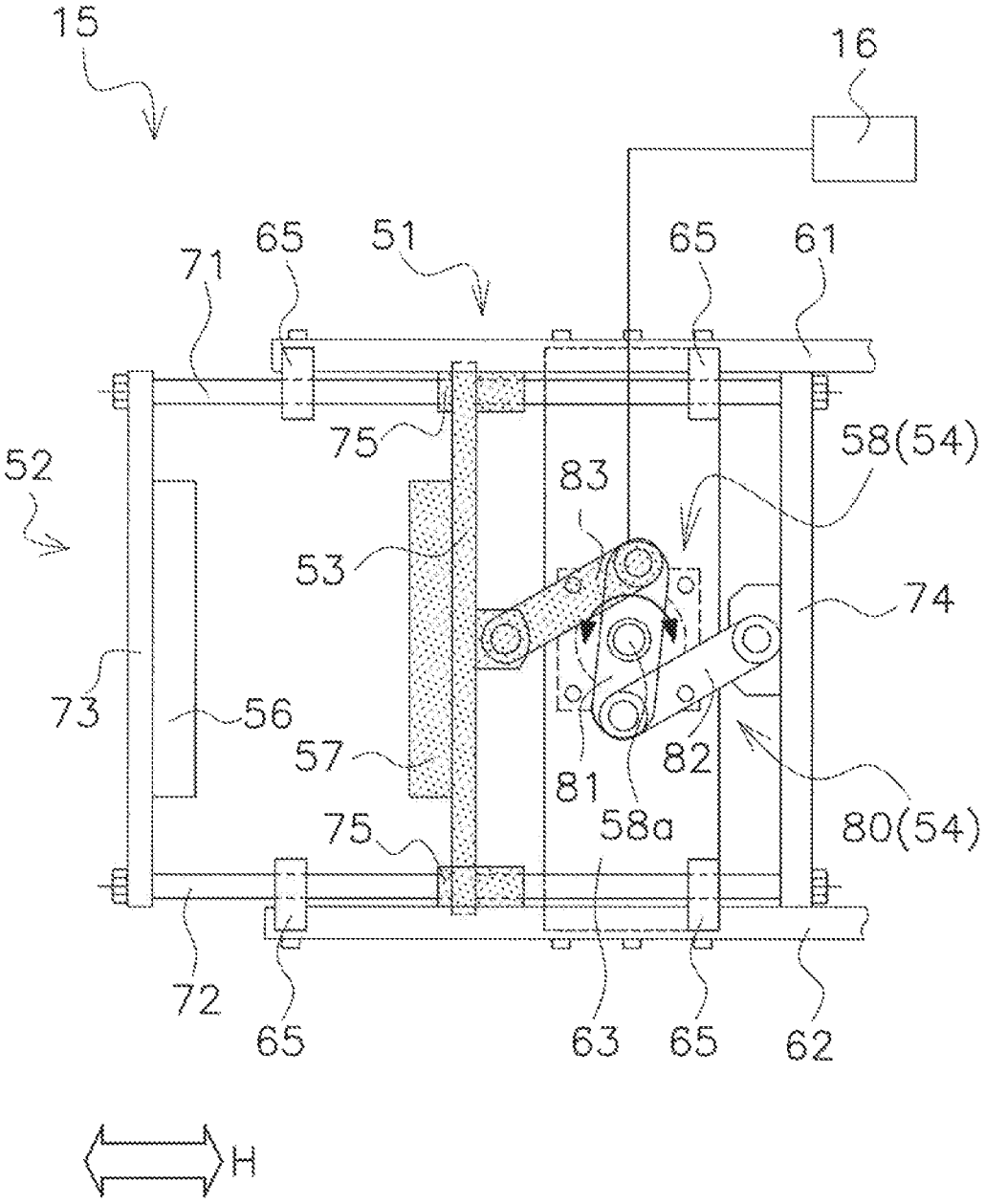
FIG. 3 is a plan view of the transverse sealing mechanism 15.

FIG. 2 and FIG. 3 are plan views of the transverse sealing mechanism 15. The transverse sealing mechanism 15 mainly has a platform 51, a horizontal moving frame 52, a slide member 53, a horizontal moving mechanism 54, a vertical moving mechanism 55, the first sealing jaw 56, and the second sealing jaw 57.

(3-1) Platform

The platform 51 has a first side frame 61, a second side frame 62, a first coupling member 63, a second coupling member 64, and plural guides 65. The first coupling member 63 and the second coupling member 64 couple the first side frame 61 and the second side frame 62 to each other. The guides 65 are secured to the first side frame 61 or the second side frame 62.

(3-2) Horizontal Moving Frame

The horizontal moving frame 52 is movable in the horizontal direction H with respect to the platform 51. The horizontal moving frame 52 has a first slide rod 71, a second slide rod 72, a first base member 73, and a second base member 74. The first slide rod 71 is disposed along the first side frame 61. The second slide rod 72 is disposed along the second side frame 62. The first base member 73 and the second base member 74 are secured to both ends of the first slide rod 71 and the second slide rod 72. The first slide rod 71 and the second slide rod 72 are supported by the guides 65 of the platform 51 so as to be slidable in the horizontal direction H.

(3-3) Slide Member

The slide member 53 bridges the first slide rod 71 and the second slide rod 72. Sliders 75 are provided on both ends of the slide member 53. The sliders 75 are slidable in the horizontal direction H with respect to the first slide rod 71 and the second slide rod 72.

(3-4) Horizontal Moving Mechanism

The horizontal moving mechanism 54 has a horizontal moving motor 58 and a horizontal link mechanism 80. The horizontal moving mechanism 54 moves the first sealing jaw 56 and the second sealing jaw 57 toward or away from each other in the horizontal direction H.

The horizontal moving motor 58 generates power that moves the first sealing jaw 56 and the second sealing jaw 57 in the horizontal direction H. The horizontal moving motor 58 is rotatable in both a forward direction and a reverse direction.

The horizontal link mechanism 80 transmits the power of the horizontal moving motor 58 to the horizontal moving frame 52 and the slide member 53. As shown in FIG. 2, the horizontal link mechanism 80 has a first link 81, a second link 82, and a third link 83.

A rotating shaft 58*a* is secured to the center of the first link 81. The rotating shaft 58*a* is rotated by the horizontal moving motor 58. The rotating shaft 58*a* is rotatable in both a forward direction and a reverse direction. The rotating shaft 58*a* may be a shaft directly coupled to a rotor of the horizontal moving motor 58. The rotating shaft 58*a* may also be a shaft rotated by a gear box or a belt attached to the horizontal moving motor 58. In accompaniment with the rotation of the rotating shaft 58*a*, the first link 81 also rotates.

The second link 82 and the third link 83 are rotatably coupled to both end portions of the first link 81. The second link 82 is coupled to the second base member 74. The third link 83 is coupled to the slide member 53.

(3-5) First Sealing Jaw and Second Sealing Jaw

The first sealing jaw 56 is attached to the first base member 73 of the horizontal moving frame 52. The second sealing jaw 57 is attached to the slide member 53. Heaters (not shown in the drawings) are provided in the first sealing jaw 56 and the second sealing jaw 57. A movable knife (not shown in the drawings) is provided in at least one of the first sealing jaw 56 and the second sealing jaw 57.

In FIG. 2, the first sealing jaw 56 and the second sealing jaw 57 are in positions near each other. In FIG. 3, the first sealing jaw 56 and the second sealing jaw 57 are in positions away from each other. When the rotating shaft 58*a* rotates a predetermined angle in the state shown in FIG. 2, the arrangement of the horizontal link mechanism 80 switches to the state shown in FIG. 3. When the rotating shaft 58*a* rotates a predetermined angle in the state shown in FIG. 3, the arrangement of the horizontal link mechanism 80 switches to the state shown in FIG. 2.

(3-6) Vertical Moving Mechanism

Figure 4:
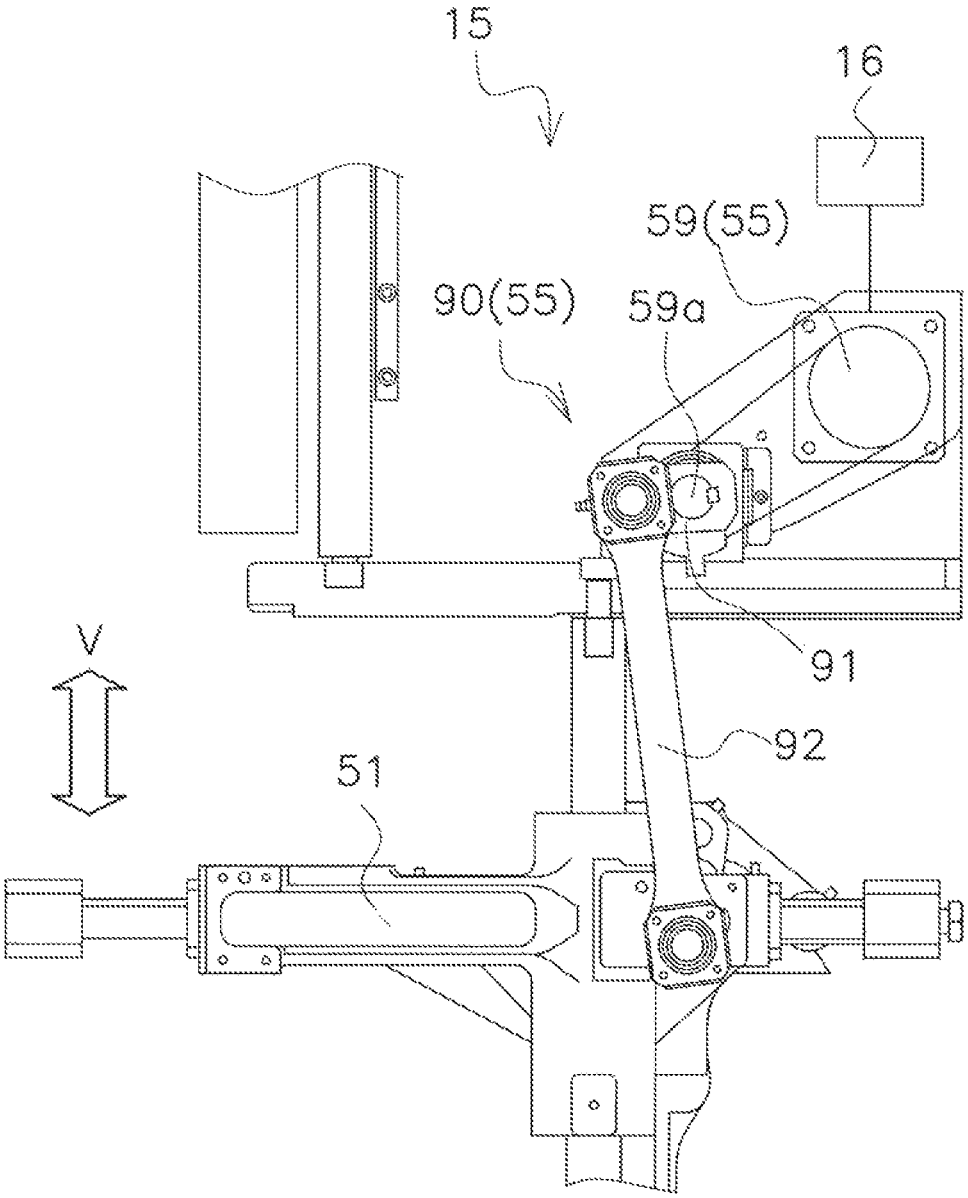
FIG. 4 is a side view of the transverse sealing mechanism 15.

FIG. 4 is a side view of the transverse sealing mechanism 15. The vertical moving mechanism 55 has a vertical moving motor 59 and a vertical link mechanism 90. The vertical moving mechanism 55 changes the position of the first sealing jaw 56 and the second sealing jaw 57 in the vertical direction V.

The vertical moving motor 59 generates power for moving the first sealing jaw 56 and the second sealing jaw 57 in the vertical direction V. The vertical moving motor 59 is rotatable in both a forward direction and a reverse direction.

The vertical link mechanism 90 transmits the power of the vertical moving motor 59 to the platform 51. The vertical link mechanism 90 has a first link 91 and a second link 92.

A rotating shaft 59*a* is secured to one end of the first link 91. The rotating shaft 59*a* is rotated by the vertical moving motor 59. The rotating shaft 59*a* is rotatable in both a forward direction and a reverse direction. The rotating shaft 59*a* may be a shaft directly coupled to a rotor of the vertical moving motor 59. The rotating shaft 59*a* may also be a shaft rotated by a gear box or a belt attached to the vertical moving motor 59. In accompaniment with the rotation of the rotating shaft 59*a*, the first link 91 also rotates.

The second link 92 is rotatably coupled to the other end of the first link 91. The second link 92 is coupled to the first side frame 61 or the second side frame 62 of the platform 51. When the rotating shaft 59*a* rotates, the platform 51 moves in the vertical direction V, and the first sealing jaw 56 and the second sealing jaw 57 also move in the vertical direction V.

(4) Configuration of Receiving Member

Figure 5:
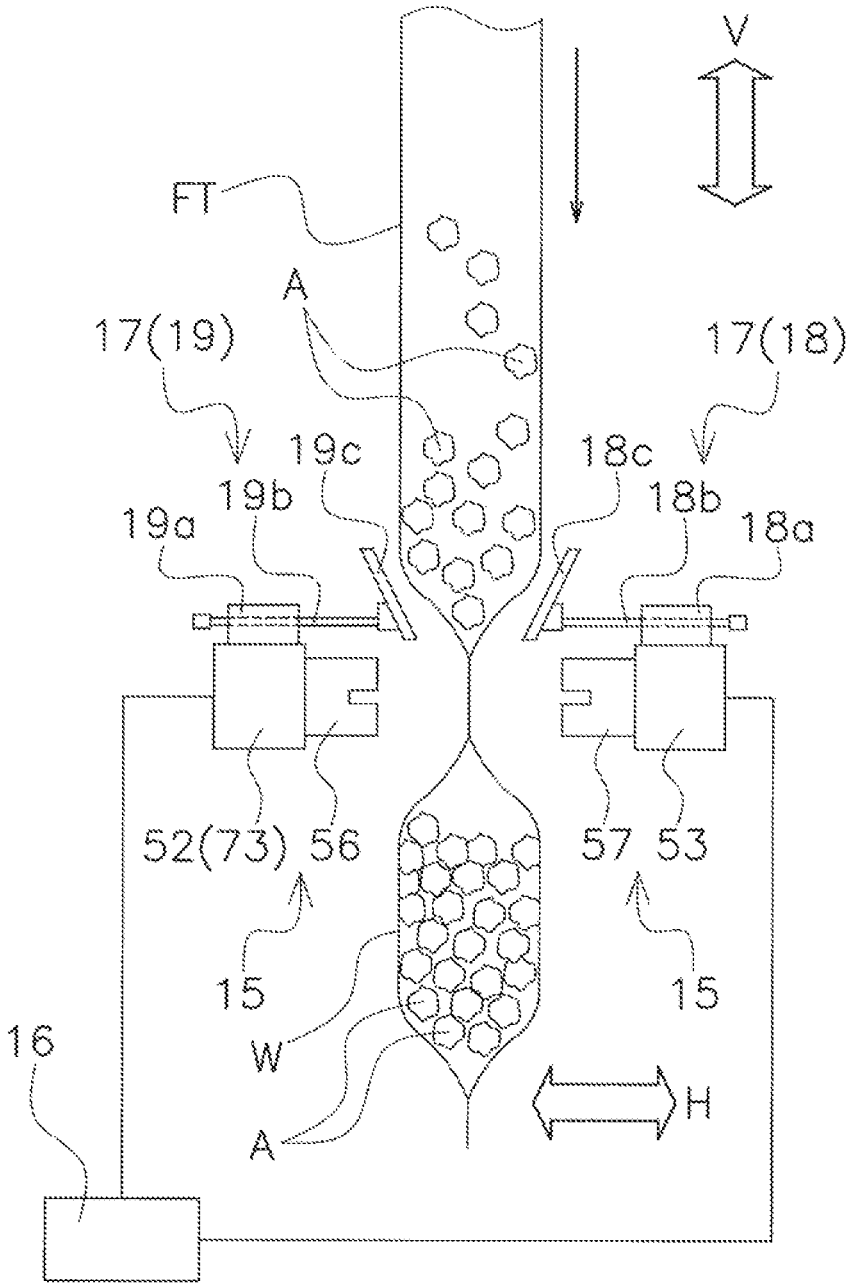
FIG. 5 is a side view showing the detailed configurations of the transverse sealing mechanism 15 and a receiving member 17.

FIG. 5 is a side view showing the detailed configuration of the transverse sealing mechanism 15 and the receiving member 17. The receiving member 17 has a first receiving component 18 and a second receiving component 19. The receiving member 17 receives the articles A that drop through the inside of the film tube FT and inhibits the articles A from dropping downward beyond the receiving member 17, by sandwiching the film tube FT with the first receiving component 18 and the second receiving component 19.

The receiving member 17 is disposed integrally with the transverse sealing mechanism 15. Specifically, the positions of the first receiving component 18 and the second receiving component 19 are fixed with respect to the transverse sealing mechanism 15 in the vertical direction V. In other words, the distance between the first receiving component 18 or the second receiving component 19 and the first sealing jaw 56 or the second sealing jaw 57 in the vertical direction V is always constant.

The first receiving component 18 mainly has a first fixed portion 18*a*, a first slide portion 18*b*, and a first contact portion 18*c*. The first fixed portion 18*a* is attached to the upper surface of the slide member 53 of the transverse sealing mechanism 15. The first slide portion 18*b* is slidable in the horizontal direction H with respect to the first fixed portion 18*a* through the first fixed portion 18*a*. The first contact portion 18*c* is attached to the first slide portion 18*b*. The first contact portion 18*c* contacts the outer surface of the film tube FT when the receiving member 17 receives the articles A.

The second receiving component 19 mainly has a second fixed portion 19*a*, a second slide portion 19*b*, and a second contact portion 19*c*. The second fixed portion 19*a* is attached to the upper surface of the first base member 73 of the horizontal moving frame 52 of the transverse sealing mechanism 15. The second slide portion 19*b* is slidable in the horizontal direction H with respect to the second fixed portion 19*a* through the second fixed portion 19*a*. The second contact portion 19*c* is attached to the second slide portion 19*b*. The second contact portion 19*c* contacts the outer surface of the film tube FT when the receiving member 17 receives the articles A.

As shown in FIG. 5, the first contact portion 18*c* and the second contact portion 19*c* oppose each other across the film tube FT. Front surfaces of the first contact portion 18*c* and the second contact portion 19*c* that oppose the outer surface of the film tube FT are contact surfaces that contact the outer surface of the film tube FT. The contact surfaces are inclined with respect to the vertical direction V. Specifically, as shown in FIG. 5, the distance between the contact surface of the first contact portion 18*c* and the contact surface of the second contact portion 19*c* in the horizontal direction H gradually increases heading upward from below. When the receiving member 17 receives the articles A, the film tube FT is sandwiched by the contact surface of the first contact portion 18*c* and the contact surface of the second contact portion 19*c*. The articles A that drop through the inside of the film tube FT hit the film tube FT and are received by the receiving member 17 at the height position at which the film tube FT is sandwiched by the first contact portion 18*c* and the second contact portion 19*c*.

The contact surfaces of the first contact portion 18*c* and the second contact portion 19*c* are covered by members having elasticity, such as sponges. Because of this, when the receiving member 17 receives the articles A that drop through the inside of the film tube FT, shock when the articles A hit the film tube FT is reduced.

(5) Actions of Transverse Sealing Mechanism

Figure 6:
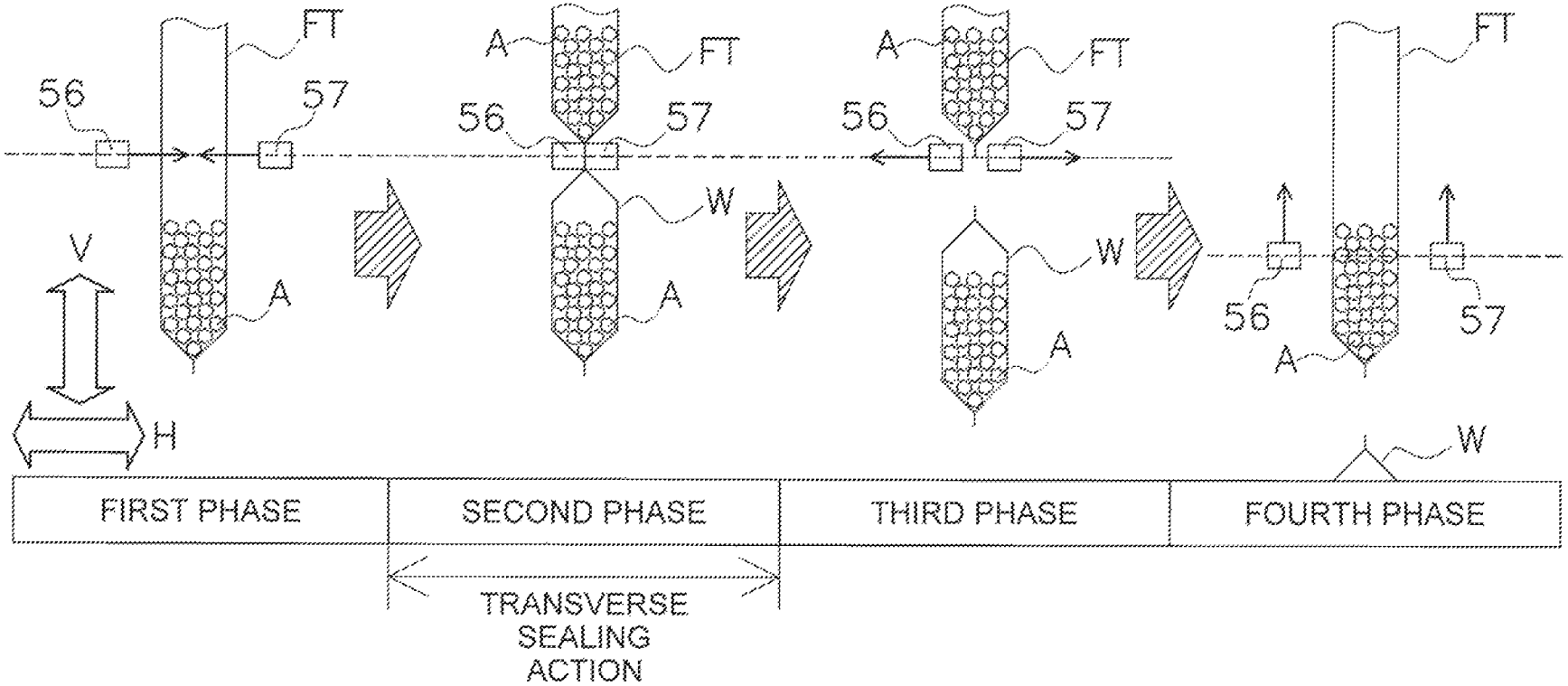
FIG. 6 is a drawing for describing the actions of a first sealing jaw 56 and a second sealing jaw 57.

FIG. 6 is a drawing for describing the actions of the first sealing jaw 56 and the second sealing jaw 57. To facilitate understanding, the receiving member 17 is omitted in FIG. 6. The actions in which the first sealing jaw 56 and the second sealing jaw 57 transversely seal the film tube FT to make the bags W in which the articles A are packaged comprise the following first to fourth phases. However, there are cases where the fourth phase is not executed. As shown in FIG. 6, before the start of the first phase, the quantity of the articles A to be packaged in one of the bags W has already been put into the inside of the film tube FT below the first sealing jaw 56 and the second sealing jaw 57.

When the first phase starts, the first sealing jaw 56 and the second sealing jaw 57 are away from each other. In the first phase, the first sealing jaw 56 and the second sealing jaw 57 are moved in the horizontal direction H toward each other by the horizontal moving mechanism 54. The first phase ends when the first sealing jaw 56 and the second sealing jaw 57 contact the film tube FT.

When the second phase starts, the first sealing jaw 56 and the second sealing jaw 57 press against the film tube FT. Next, the first sealing jaw 56 and the second sealing jaw 57 apply heat to the film tube FT and transversely seal the film tube FT. At this time, a bag W in which the articles A are packaged is made under a transverse seal portion that is the transversely sealed portion of the film tube FT. Next, the movable knife provided in the first sealing jaw 56 or the second sealing jaw 57 cuts the transverse seal portion in the horizontal direction H, and the second phase ends. When the transverse seal portion is cut, the bag W is cut away from the film tube FT above it and drops. While the film tube FT is being transversely sealed, the control unit 16 may stop the conveyance of the film tube FT or may reduce the conveyance speed of the film tube FT.

In the third phase, the first sealing jaw 56 and the second sealing jaw 57 are moved in the horizontal direction H away from each other by the horizontal moving mechanism 54. The third phase ends when the distance separating the first sealing jaw 56 and the second sealing jaw 57 reaches a maximum.

In the fourth phase, the position of the first sealing jaw 56 and the second sealing jaw 57 in the vertical direction V is returned to the position they are in when the first phase starts.

It will be noted that in a case where the position of the first sealing jaw 56 and the second sealing jaw 57 in the vertical direction V is changed in the first to third phases, the position of the first sealing jaw 56 and the second sealing jaw 57 in the vertical direction V is returned in the fourth phase to the position they are in when the first phase starts. In a case where the position of the first sealing jaw 56 and the second sealing jaw 57 in the vertical direction V is not changed in the first to third phases, the fourth phase is not executed.

The bag-making and packaging machine 10 can continuously make the bags W in which the articles A are packaged by repeating the above actions of the first to fourth phases or the first to third phases.

(6) Control of Vertical Moving Mechanism

The vertical moving mechanism 55 changes the position of the transverse sealing mechanism 15 in the vertical direction V. As mentioned above, the distance between the transverse sealing mechanism 15 and the receiving member 17 in the vertical direction V is constant. For that reason, the vertical moving mechanism 55 changes the position of the receiving member 17 in the vertical direction V together with that of the transverse sealing mechanism 15.

Next, the actions in which the control unit 16 controls the vertical moving mechanism 55 to change the positions of the transverse sealing mechanism 15 and the receiving member 17 in the vertical direction V will be described. Below, in the first to third phases, as shown in FIG. 6, the vertical moving mechanism 55 will not change the positions of the transverse sealing mechanism 15 and the receiving member 17 in the vertical direction V.

After the start of the first phase and before the end of the fourth phase, the quantity of the articles A to be packaged in one of the bags W drops through the inside of the film tube FT above the transverse sealing mechanism 15. The articles A that have dropped through the inside of the film tube FT are received by the receiving member 17.

The article discharge apparatus 20 discharges at one time, or discharges over multiple times, the quantity of the articles A to be packaged in one of the bags W in a packaging process in which the articles A are packaged in one of the bags W (a process comprising the first to fourth phases). Next, the actions in which the vertical moving mechanism 55 changes the positions of the transverse sealing mechanism 15 and the receiving member 17 in the vertical direction V in accordance with the number of times the articles A are discharged from the article discharge apparatus 20 will be described with reference to FIG. 7 and FIG. 8.

Figure 7:
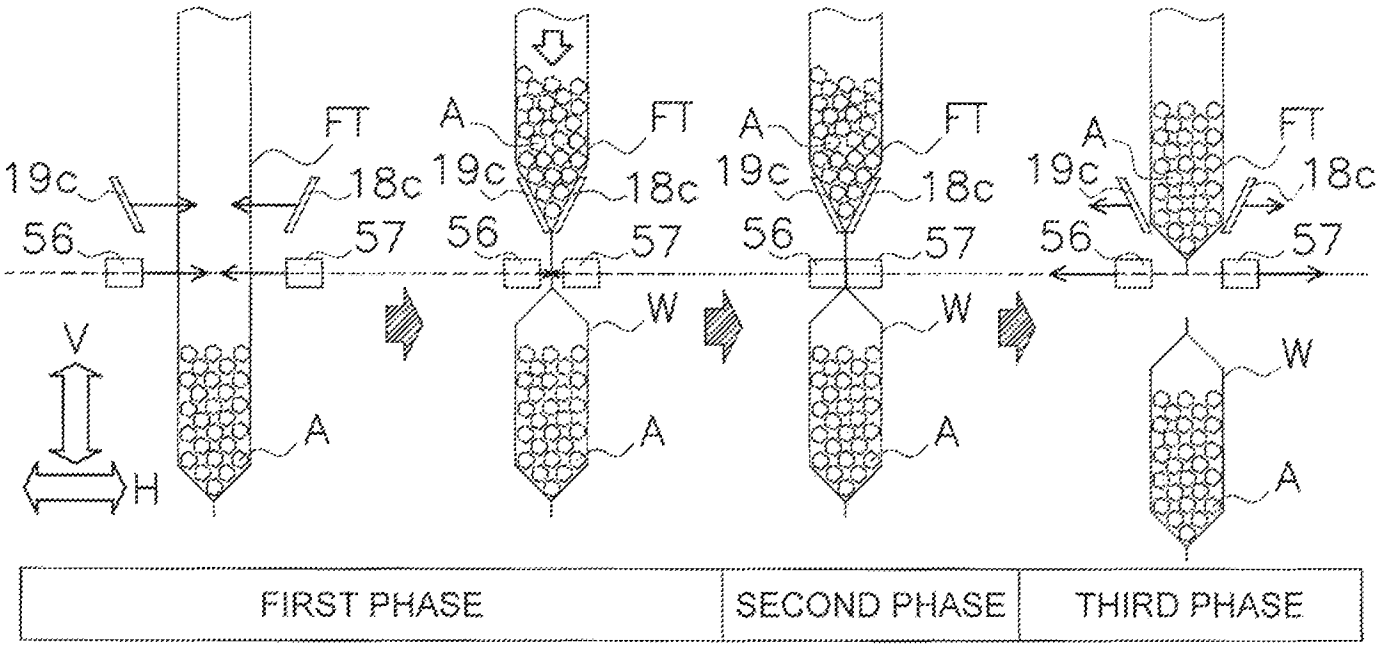
FIG. 7 is a drawing for describing the actions of the transverse sealing mechanism 15 and the receiving member 17.
Figure 8:
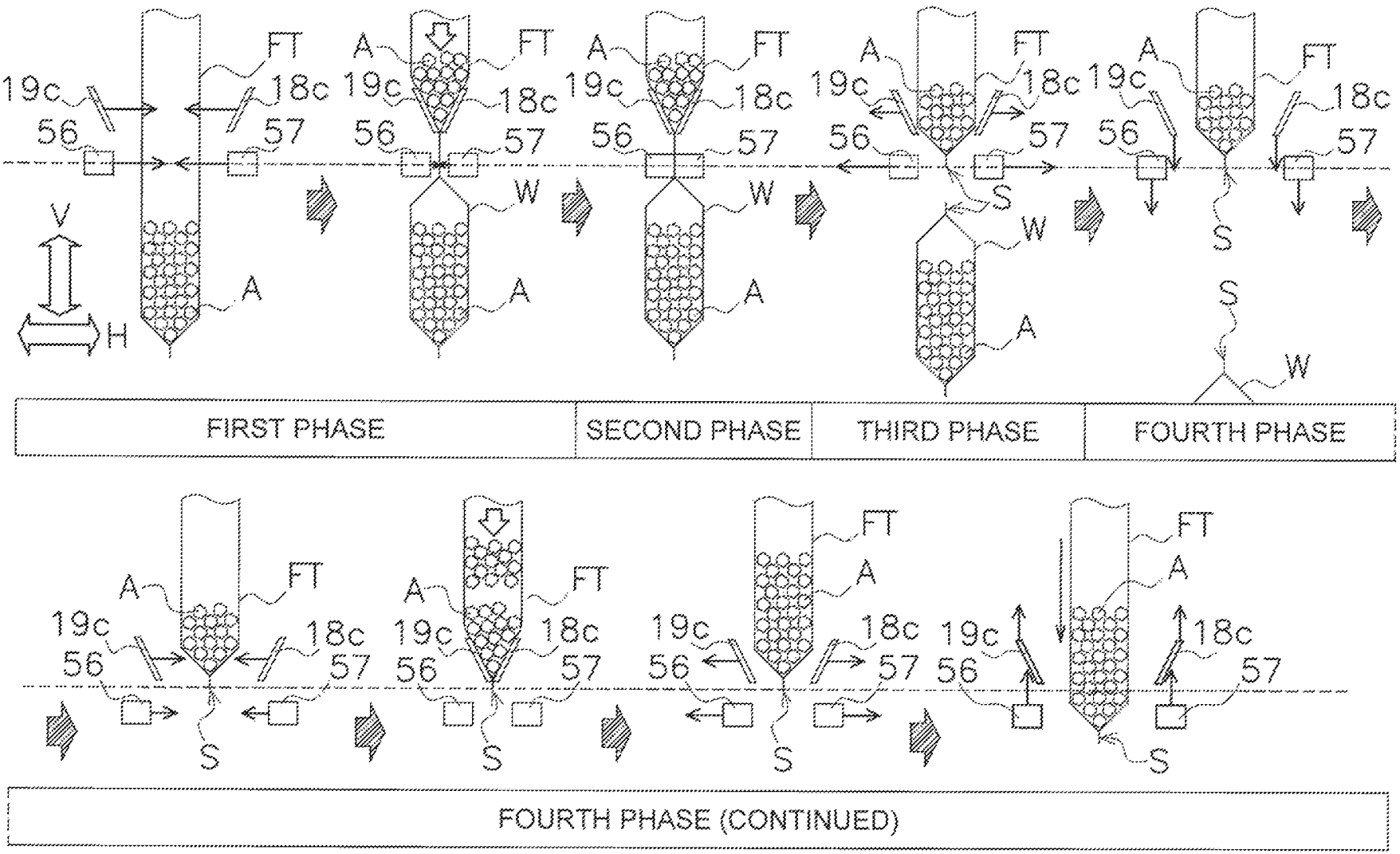
FIG. 8 is a drawing for describing the actions of the transverse sealing mechanism 15 and the receiving member 17.

FIG. 7 and FIG. 8 are drawings for describing the actions of the transverse sealing mechanism 15 and the receiving member 17. In FIG. 7 and FIG. 8, only the first sealing jaw 56 and the second sealing jaw 57 are shown as the transverse sealing mechanism 15, and only the first contact portion 18*c* and the second contact portion 19*c* are shown as the receiving member 17. In FIG. 7 and FIG. 8, the position of the first sealing jaw 56 and the second sealing jaw 57 when the first phase starts is indicated by the dashed line.

(6-1) Case Where Articles Are Discharged Only One Time

FIG. 7 shows a case where the article discharge apparatus 20 discharges at one time the quantity of the articles A to be packaged in one of the bags W. In this case, for example, the articles A are discharged from the article discharge apparatus 20 just before the film tube FT is transversely sealed in the second phase. Next, the actions of the first contact portion 18*c* and the second contact portion 19*c* in each phase will be described.

When the first phase starts, the first contact portion 18*c* and the second contact portion 19*c* are away from each other. In the first phase, the first contact portion 18*c* and the second contact portion 19*c* are moved in the horizontal direction H toward each other by the horizontal moving mechanism 54 and contact the outer surface of the film tube FT. Thereafter, the first contact portion 18*c* and the second contact portion 19*c* receive the articles A discharged from the article discharge apparatus 20.

In the second phase, the film tube FT is transversely sealed and the bag W is cut away from the film tube FT while the first contact portion 18*c* and the second contact portion 19*c* remain in contact with the outer surface of the film tube FT.

In the third phase, the first contact portion 18*c* and the second contact portion 19*c* are moved in the horizontal direction H away from each other by the horizontal moving mechanism 54. Because of this, the first contact portion 18*c* and the second contact portion 19*c* separate from the outer surface of the film tube FT. Thereafter, the film tube FT is conveyed downward and the process transitions to the first phase.

In this case, the vertical moving mechanism 55 does not change the positions of the transverse sealing mechanism 15 and the receiving member 17 in the vertical direction V, so after the end of the third phase, the process transitions to the first phase without the actions of the fourth phase being performed.

(6-2) Case Where Articles Are Discharged Over Multiple Times

Next, a case where the article discharge apparatus 20 discharges over multiple times the quantity of the articles A to be packaged in one of the bags W will be described. As an example, FIG. 8 shows a case where the article discharge apparatus 20 discharges over two times the quantity of the articles A to be packaged in one of the bags W. In this case, for example, the portion of the articles A discharged the first time is discharged just before the film tube FT is transversely sealed in the second phase. Thereafter, the portion of the articles A discharged the second time is discharged in the fourth phase. Next, the actions of the first contact portion 18*c* and the second contact portion 19*c* in each phase will be described.

When the first phase starts, the first contact portion 18*c* and the second contact portion 19*c* are away from each other. In the first phase, the first contact portion 18*c* and the second contact portion 19*c* are moved in the horizontal direction H toward each other by the horizontal moving mechanism 54 and contact the outer surface of the film tube FT. Thereafter, the first contact portion 18*c* and the second contact portion 19*c* receive the portion of the articles A discharged the first time from the article discharge apparatus 20.

In the second phase, the film tube FT is transversely sealed and the bag W is cut away from the film tube FT while the first contact portion 18*c* and the second contact portion 19*c* remain in contact with the outer surface of the film tube FT.

In the third phase, the first contact portion 18*c* and the second contact portion 19*c* are moved in the horizontal direction H away from each other by the horizontal moving mechanism 54. Because of this, the first contact portion 18*c* and the second contact portion 19*c* separate from the outer surface of the film tube FT.

In the fourth phase, the vertical moving mechanism 55 moves the transverse sealing mechanism 15 and the receiving member 17 a predetermined distance downward to change their positions in the vertical direction V. Thereafter, the first contact portion 18*c* and the second contact portion 19*c* are moved in the horizontal direction H toward each other by the horizontal moving mechanism 54. Because of this, the first contact portion 18*c* and the second contact portion 19*c* contact the transverse seal portion S of the film tube FT. Specifically, as shown in FIG. 8, the lower portions of the first contact portion 18*c* and the second contact portion 19*c* contact the transverse seal portion S, and the upper portions of the first contact portion 18*c* and the second contact portion 19*c* contact the outer surface of the film tube FT above the transverse seal portion S. Thereafter, the first contact portion 18*c* and the second contact portion 19*c* receive the portion of the articles A discharged the second time from the article discharge apparatus 20.

Next, in the fourth phase, the first contact portion 18*c* and the second contact portion 19*c* are moved in the horizontal direction H away from each other by the horizontal moving mechanism 54. Because of this, the first contact portion 18*c* and the second contact portion 19*c* separate from the outer surface of the film tube FT. Finally, the vertical moving mechanism 55 moves the transverse sealing mechanism 15 and the receiving member 17 a predetermined distance upward to change their positions in the vertical direction V. Because of this, the vertical moving mechanism 55 returns the position of the first sealing jaw 56 and the second sealing jaw 57 in the vertical direction V to the position they are in when the first phase starts. At this time, the film tube FT is conveyed downward. In the fourth phase, the first sealing jaw 56 and the second sealing jaw 57 are always away from each other. After the end of the fourth phase, the process transitions to the first phase.

In this way, the control unit 16 controls the vertical moving mechanism 55 to switch the positions of the transverse sealing mechanism 15 and the receiving member 17 in the vertical direction V. Specifically, the control unit 16 controls the vertical moving mechanism 55 in a first mode in the first to third phases and controls the vertical moving mechanism 55 in a second mode in the fourth phase in accordance with the position in the vertical direction V. The control unit 16 switches between the first mode and the second mode in accordance with the situation in the process of packaging the articles A in one of the bags W.

The first mode is the mode shown in the upper level of FIG. 8. The first mode is a mode in which the receiving member 17 contacts the outer surface of the film tube FT above the transverse seal portion S of the film tube FT. In the first mode, the transverse sealing mechanism 15 is in a height position at which it can transversely seal the film tube FT.

The second mode is the mode shown in the lower level of FIG. 8. The second mode is a mode in which the receiving member 17 contacts the outer surface of the film tube FT at a height position (a second height position) lower than the height position (a first height position) at which the receiving member 17 contacts the outer surface of the film tube FT in the first mode. In the second mode, the transverse sealing mechanism 15 is in a lower height position than the transverse seal portion S of the film tube FT. In the second mode, the receiving member 17 contacts the transverse seal portion S of the film tube FT. Specifically, when the first contact portion 18*c* and the second contact portion 19*c* move toward each other in the fourth phase, the lower portions of the first contact portion 18*c* and the second contact portion 19*c* contact the transverse seal portion S, and the upper portions of the first contact portion 18*c* and the second contact portion 19*c* contact the outer surface of the film tube FT above the transverse seal portion S.

The above description is also applicable to a case where the article discharge apparatus 20 discharges over three or more times the quantity of the articles A to be packaged in one of the bags W. In this case, in the fourth phase the receiving member 17 continuously receives the portions of the articles A discharged the second time on from the article discharge apparatus 20.

(7) Characteristics (7-1)

The bag-making and packaging machine 10 of this embodiment changes the height position of the receiving member 17 in a case where the receiving member 17 receives over multiple times the quantity of the articles A to be packaged in one of the bags W. Specifically, first, the receiving member 17 receives the portion of the articles A discharged the first time from the article discharge apparatus 20, and the transverse sealing mechanism 15 transversely seals the film tube FT. Thereafter, the transverse sealing mechanism 15 moves the first sealing jaw 56 and the second sealing jaw 57 away from each other. Because of this, the first sealing jaw 56 and the second sealing jaw 57 separate from the film tube FT, so the film tube FT is inhibited from being damaged by the heat of the first sealing jaw 56 and the second sealing jaw 57. At this time, the receiving member 17 also separates from the film tube FT, so as shown in FIG. 8, the articles A inside the film tube FT drop to the height position of the upper end of the transverse seal portion S. Thereafter, the control unit 16 controls the vertical moving mechanism 55 to move the receiving member 17 downward. The receiving member 17 receives the portions of the articles A discharged the second time on at a lower height position than the height position at which it received the portion of the articles A discharged the first time.

Here, a case will be considered where the control unit 16 does not move the receiving member 17 downward and where the receiving member 17 receives the portions of the articles A discharged the second time on at the same height position as the height position at which it received the portion of the articles A discharged the first time. In this case, the articles A that have dropped to the height position of the upper end of the transverse seal portion S after the receiving member 17 has separated from the film tube FT following the transverse sealing become pinched by the first contact portion 18*c* and the second contact portion 19*c* of the receiving member 17. Because of this, there is the concern that the articles A that have dropped through the inside of the film tube FT will be damaged, and that the film tube FT will also be damaged by the damaged articles A.

However, in the bag-making and packaging machine 10 of this embodiment, the control unit 16 changes the height position of the receiving member 17, so that when the receiving member 17 receives the portions of the articles A discharged the second time on, the articles A inside the film tube FT are inhibited from being pinched by the first contact portion 18*c* and the second contact portion 19*c*. Consequently, the bag-making and packaging machine 10 can inhibit damage to the articles A inside the film tube FT and to the film tube FT.

Furthermore, in the bag-making and packaging machine 10 of this embodiment, it is not necessary to install a new mechanism for temporarily receiving the articles A that have dropped through the inside of the film tube FT above the transverse sealing mechanism 15. For that reason, the bag-making and packaging machine 10 can inhibit, at a low cost, damage to the articles A and to the film tube FT without significantly retrofitting existing equipment.

(7-2)

The receiving member 17 has the first contact portion 18*c* and the second contact portion 19*c* that contact the outer surface of the film tube FT when the receiving member 17 receives the articles A that have dropped through the inside of the film tube FT. The contact surfaces (the surfaces that contact the outer surface of the film tube FT) of the first contact portion 18*c* and the second contact portion 19*c* are inclined with respect to the vertical direction V as shown in FIG. 5. For that reason, when the receiving member 17 receives the portions of the articles A discharged the second time on from the article discharge apparatus 20, the lower portions of the first contact portion 18*c* and the second contact portion 19*c* contact the transverse seal portion S of the film tube FT, and the upper portions of the first contact portion 18*c* and the second contact portion 19*c* contact the outer surface of the film tube FT above the transverse seal portion S. Because of this, when the first contact portion 18*c* and the second contact portion 19*c* contact the outer surface of the film tube FT, the articles A inside the film tube FT are pushed upward. As a result, damage to the articles A and to the film tube FT caused by the articles A being pinched by the first contact portion 18*c* and the second contact portion 19*c* is inhibited.

(7-3)

The lower ends of the first contact portion 18*c* and the second contact portion 19*c* are the portions that project the most toward the film tube FT. When the lower ends of the first contact portion 18*c* and the second contact portion 19*c* contact the outer surface of the film tube FT, there is the concern that the film tube FT will become bent at the place where they have contacted it, leaving marks.

When the receiving member 17 receives the portions of the articles A discharged the second time on from the article discharge apparatus 20, the lower ends of the first contact portion 18*c* and the second contact portion 19*c* contact the transverse seal portion S of the film tube FT as shown in FIG. 8. For that reason, the lower ends of the first contact portion 18*c* and the second contact portion 19*c* do not repeatedly contact the outer surface of the film tube FT, so marks are inhibited from being left in the film tube FT by contact with the receiving member 17.

(7-4)

When the receiving member 17 receives the portions of the articles A discharged the second time on from the article discharge apparatus 20, the transverse sealing mechanism 15 is in a position in which it does not contact the transverse seal portion S of the film tube FT. For that reason, the film tube FT is inhibited from being damaged by the heat of the first sealing jaw 56 and the second sealing jaw 57.

(8) Example Modifications (8-1) Example Modification A

In the embodiment, the height position of the receiving member 17 is changed in a case where the receiving member 17 receives the articles A discharged over multiple times from the article discharge apparatus 20. Specifically, the receiving member 17 receives the portions of the articles A discharged the second time on at a lower height position than the height position at which it received the portion of the articles A discharged the first time. In this case, the control unit 16 controls the vertical moving mechanism 55 on the basis of the first mode when the receiving member 17 receives the portion of the articles A discharged the first time. Thereafter, the control unit 16 switches from the first mode to the second mode and controls the vertical moving mechanism 55 on the basis of the second mode when the receiving member 17 receives the portions of the articles A discharged the second time on.

However, the control unit 16 does not need to switch from the first mode to the second mode in a case where the intervals at which the articles A are discharged from the article discharge apparatus 20 are short. In this case, the control unit 16 controls the vertical moving mechanism 55 on the basis of the first mode even when the receiving member 17 receives the portions of the articles A discharged the second time on.

In this example modification, the control unit 16 controls the vertical moving mechanism 55 on the basis of the first mode until the receiving member 17 receives the portion of the articles A discharged the first time as in the embodiment. The control unit 16 switches from the first mode to the second mode in a case where a predetermined amount of time has elapsed since the point in time when the receiving member 17 received the portion of the articles A discharged the first time and the control unit 16 is in the first mode at the latest point in time when the receiving member 17 received the articles A. However, the control unit 16 does not switch from the first mode to the second mode while the predetermined amount of time has not elapsed since the point in time when the receiving member 17 received the portion of the articles A discharged the first time. The predetermined amount of time is, for example, at least an amount of time required for the transverse sealing mechanism 15 to transversely seal the film tube FT.

In this example modification, in a case where the discharge intervals of the articles A are short in a case where the articles A are discharged over multiple times from the article discharge apparatus 20, the height position of the receiving member 17 is not changed until the predetermined amount of time elapses since the point in time when the receiving member 17 first received the articles A. For that reason, the receiving member 17 can continuously receive the articles A at the same height position. Specifically, the receiving member 17 can continuously receive the articles A before the film tube FT is transversely sealed in the second phase and the process transitions to the third phase. While the receiving member 17 is continuously receiving the articles A, the process does not transition to the third phase in which the first sealing jaw 56 and the second sealing jaw 57 separate from the film tube FT. In that case also, the amount of time in which the receiving member 17 is continuously receiving the articles A is kept down, so it is not likely for the film tube FT to be damaged by the heat of the first sealing jaw 56 and the second sealing jaw 57.

In this example modification, the number of times the control unit 16 switches between the first mode and the second mode can be kept down. That is, in the fourth phase, the number of times the vertical moving mechanism 55 changes the positions of the transverse sealing mechanism 15 and the receiving member 17 in the vertical direction V can be kept down. For that reason, the bag-making and packaging machine 10 can shorten the amount of time it takes for the process of packaging the articles A.

(8-2) Example Modification B

In the embodiment and example modification A, the control unit 16 switches between the first mode and the second mode as needed and controls the vertical moving mechanism 55 in a case where the articles A are discharged over multiple times from the article discharge apparatus 20. In this case, the control unit 16 may also communicate with the article discharge apparatus 20 to acquire information relating to the points in time when the articles A have been discharged from the article discharge apparatus 20.

Specifically, the control unit 16 may send a discharge request signal to the article discharge apparatus 20 and receive a discharge completion signal from the article discharge apparatus 20. The discharge request signal is a signal for requesting a discharge of the articles A from the article discharge apparatus 20. The discharge completion signal is a signal indicating that the article discharge apparatus 20 that received the discharge request signal has completed the discharge of the articles A.

Figure 9:
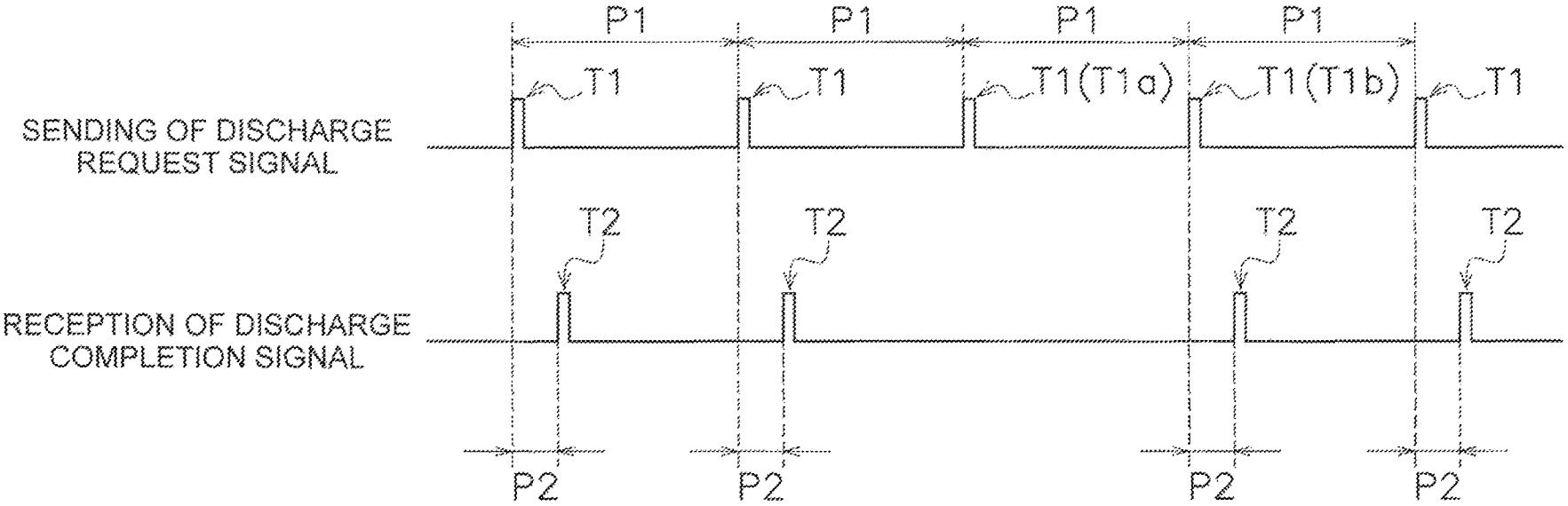
FIG. 9 is a time chart showing points in time when a control unit 16 sends a discharge request signal T1 and points in time when the control unit 16 receives a discharge completion signal T2 in example modification B.

FIG. 9 is an example of a time chart showing points in time when the control unit 16 sends the discharge request signal T1 and points in time when the control unit 16 receives the discharge completion signal T2. The control unit 16 sends the discharge request signal T1 at predetermined intervals P1. The intervals P1 are constant. In a case where the article discharge apparatus 20 can discharge the articles A in response to the discharge request signal T1 it has received from the control unit 16, it sends the discharge completion signal T2 to the control unit 16 after the discharge of the articles A. In this case, intervals P2 from the points in time when the control unit 16 sends the discharge request signal T1 to the points in time when the control unit 16 receives the discharge completion signal T2 are constant. However, depending on the operating situation of the article discharge apparatus 20, such as a case where it takes time to weigh the articles A, there are cases where the article discharge apparatus 20 cannot discharge the articles A in response to the discharge request signal T1 it has received from the control unit 16. In this case, the article discharge apparatus 20 does not send the discharge completion signal T2 in response to the discharge request signal T1 (signal T1*a* in FIG. 9) it has received from the control unit 16. Instead, the article discharge apparatus 20 sends the discharge completion signal T2 in response to the discharge request signal T1 (signal T1*b* in FIG. 9) it has received again from the control unit 16. Consequently, as shown in FIG. 9, the intervals at which the control unit 16 receives the discharge completion signal T2 from the article discharge apparatus 20 are not constant.

In this example modification, the control unit 16 switches from the first mode to the second mode in a case where it has not received the discharge completion signal T2 within a predetermined amount of time since the point in time when it first sent the discharge request signal T1 in the packaging process in which the articles A are packed in one of the bags W (the process comprising the first to fourth phases). On the other hand, the control unit 16 does not switch from the first mode to the second mode while it is continuing to receive the discharge completion signal T2 within the predetermined amount of time since the point in time when it first sent the discharge request signal T1. The predetermined amount of time is at least an amount of time required for the transverse sealing mechanism 15 to transversely seal the film tube FT. The predetermined amount of time is, for example, set to an amount of time longer than the period P2 and shorter than the interval P1 in FIG. 9. This control is substantially the same as the control described in example modification A.

Furthermore, the control unit 16 may also switch from the first mode to the second mode in accordance with the situation even in a case where, as shown in FIG. 7, the article discharge apparatus 20 discharges at one time the quantity of the articles A to be packaged in one of the bags W. Specifically, the control unit 16 may also switch from the first mode to the second mode in a case where the period from the point in time when it sent the discharge request signal T1 to the point in time when it received the discharge completion signal T2 exceeds the predetermined amount of time.

In this example modification, the control unit 16 may also receive from the article discharge apparatus 20 a total discharge completion signal indicating that the articles A to be packaged in one of the bags W have all been discharged. In this case, the control unit 16 switches from the second mode to the first mode and transitions to the first phase in a case where it is controlling the vertical moving mechanism 55 on the basis of the second mode and it has received the total discharge completion signal from the article discharge apparatus 20.

What is claimed is:

1. A bag-making and packaging machine that packages, in bags made from a packaging material, articles discharged and dropped from an article discharge apparatus, the bag-making and packaging machine comprising:

a transverse sealing mechanism configured to transversely seal the packaging material which is tubular in shape and conveyed downward from above;

a receiving member disposed integrally with the transverse sealing mechanism above the transverse sealing mechanism, the receiving member being configured to contact an outer surface of the packaging material as the packaging material receives the articles that drop through the inside of the packaging material;

a moving mechanism that moves the transverse sealing mechanism and the receiving member in up and down directions; and a control unit configured to switch between a first mode in which the receiving member contacts the outer surface at a first height position, and a second mode in which the receiving member contacts the outer surface at a second height position lower than the first height position, the first mode being a mode in which the receiving member contacts the outer surface above a seal portion of the packaging material that has been transversely sealed by the transverse sealing mechanism, and the second mode being a mode in which the receiving member contacts the seal portion.

2. The bag-making and packaging machine according to claim 1, wherein the second mode being a mode in which lower portions of the receiving member contact the seal portion and upper portions of the receiving member contact the outer surface above the seal portion.

3. The bag-making and packaging machine according to claim 2, wherein the first mode being a mode in which the transverse sealing mechanism is at a height position at which the transverse sealing mechanism can transversely seal the packaging material, and the second mode being a mode in which the transverse sealing mechanism is at a lower height position than the seal portion.

4. The bag-making and packaging machine according to claim 2, the first mode being a mode in which the transverse sealing mechanism is at a height position at which the transverse sealing mechanism can transversely seal the packaging material, and the second mode being a mode in which the transverse sealing mechanism is in a lower height position than the seal portion.

5. The bag-making and packaging machine according to claim 1, wherein the receiving member receiving a one time discharge of articles from the article discharge apparatus or discharges of the articles from the article discharge apparatus multiple times in a packaging process in which the articles are packaged in one of the bags.

6. The bag-making and packaging machine according to claim 1, wherein the receiving member receiving discharges of the articles from the article discharge apparatus multiple times in a packaging process in which the articles are packaged in one of the bags, and the control unit is configured to control the moving mechanism in the first mode until the receiving member first receives the articles in the packaging process, and switch from the first mode to the second mode where a predetermined amount of time has elapsed since the receiving member first received the articles in the packaging process and the control unit had been controlling the moving mechanism in the first mode at the latest point in time when the receiving member has received the articles.

7. The bag-making and packaging machine according to claim 6, the predetermined amount of time being at least an amount of time required for the transverse sealing mechanism to transversely seal the packaging material.

8. The bag-making and packaging machine according to claim 1, the control unit being configured to send to the article discharge apparatus a discharge request signal requesting a discharge of the articles from the article discharge apparatus, receive from the article discharge apparatus a discharge completion signal indicating that the article discharge apparatus that received the discharge request signal has completed the discharge of the articles, and switch from the first mode to the second mode in response to the control unit not receiving the discharge completion signal within a predetermined amount of time since the point in time when the control unit sent the discharge request signal.

9. The bag-making and packaging machine according to claim 8, the predetermined amount of time being at least an amount of time required for the transverse sealing mechanism to transversely seal the packaging material.

10. The bag-making and packaging machine according to claim 1, wherein the control unit being further configured to switch from the second mode to the first mode in a case where the control unit is controlling the moving mechanism in the second mode and the control unit has received from the article discharge apparatus a signal indicating that the articles to be packaged in one of the bags have all been discharged.

* * * * *